US006548769B2

(12) United States Patent
Nomura et al.

(10) Patent No.: US 6,548,769 B2
(45) Date of Patent: Apr. 15, 2003

(54) CIRCUIT BREAKER

(75) Inventors: Koji Nomura, Saitama (JP); Naoshi Uchida, Saitama (JP); Katsunori Kuboyama, Saitama (JP); Tatsunori Takahashi, Saitama (JP); Kentaro Toyama, Kanagawa (JP)

(73) Assignee: Fuji Electric Co., Ltd., Kawasaki (JP)

( * ) Notice: Subject to any disclaimer, the term of this patent is extended or adjusted under 35 U.S.C. 154(b) by 74 days.

(21) Appl. No.: 09/825,874

(22) Filed: Apr. 5, 2001

(65) Prior Publication Data

US 2001/0030118 A1 Oct. 18, 2001

(30) Foreign Application Priority Data

Apr. 12, 2000 (JP) ..... 2000-110359

(51) Int. Cl.[7] ..... H01H 3/00; H01H 9/26; H01H 73/00

(52) U.S. Cl. ..... 200/18; 200/50.01; 361/6; 361/13; 361/17

(58) Field of Search ..... 200/330, 400, 200/401, 18, 50.01–50.4; 335/6–18, 172, 174, 185

(56) References Cited

U.S. PATENT DOCUMENTS 5,466,903 A * 11/1995 Faber et al. ..... 200/400
5,552,755 A * 9/1996 Fello et al. ..... 335/18
5,581,219 A * 12/1996 Nozawa et al. ..... 335/8 X
6,040,746 A * 3/2000 Maloney et al. ..... 335/13
6,229,414 B1 * 5/2001 Toyama et al. ..... 335/17
6,486,417 B1 * 11/2002 Toyama et al. ..... 200/17 R

* cited by examiner

*Primary Examiner*—J. R. Scott
(74) *Attorney, Agent, or Firm*—Kanesaka & Takeuchi

(57) ABSTRACT

A circuit breaker includes an opening and closing mechanism section with an opening and closing lever, and an alarm-outputting plate operating in response to a tripping operation. A case for the circuit breaker has a plurality of switch housing sections formed on a top side thereof, in which are installed an auxiliary switch for detecting an ON/OFF state of a main circuit contact and/or an alarm switch for detecting a tripping operation. The opening and closing lever and the alarm-outputting plate have outputting projecting pieces, respectively, laterally spaced apart from each other corresponding to the respective housing sections, for transmitting mechanical output signals to the switches. When the auxiliary and alarm switches are installed, the auxiliary switch is linked to the outputting projecting piece of the opening and closing lever, while the alarm switch is linked to the outputting projecting piece of the alarm-outputting plate. The auxiliary switch and the alarm switch are installed in arbitrary combinations to the circuit breaker.

5 Claims, 6 Drawing Sheets

CIRCUIT BREAKER

BACKGROUND OF THE INVENTION AND RELATED ART STATEMENT

The present invention relates to a molded-case circuit breaker or circuit breaker for distribution used to protect low-voltage distributing facilities from an excessive current, more specifically, to a circuit breaker equipped with an auxiliary switch and an alarm switch acting as internally attached devices (optional parts) for detecting the ON/OFF state of a main circuit contact or a tripping operation through an electric signal.

FIG. 7 shows a conventional configuration of a molded-case circuit breaker comprising a circuit breaker body equipped with an auxiliary switch as an internally attached device (optional part). In this figure, reference numeral 1 denotes a case (resin-molded case) of the circuit breaker body having a main-circuit breaking section 2, an opening and closing mechanism section 3, and a tripping section 4 integrated therein. In this configuration, a main circuit contact of the breaking section 2 is opened or closed by means of the opening and closing mechanism section 3 based on a manual operation of a handle 5. If an excess current flows through a main circuit, an output signal from the tripping section 4 trips the opening and closing mechanism section 3 to open the main circuit contact. The opening and closing mechanism section 3 is combined with an opening and closing lever 6 to link its tip to an assembly (not shown) of movable contact shoes of the breaking section 2, so that the opening and closing lever 6 can be pivoted and operated in response to the operation of the opening and closing mechanism section 3, thereby opening or closing the main circuit contact.

Further, an auxiliary switch 7 as an internally attached device is installed as a cassette in an attached unit housing section formed on a top surface of the case 1. At this installed position, an operating lever 7*a* drawn out from the auxiliary switch 7 is placed opposite an outputting projecting piece 6*a* formed on the opening and closing lever 6, so that a contact of the auxiliary switch 7 can be opened and closed in response to an opening or closing operation of the main circuit contact to detect the ON/OFF state of the main circuit as an electric signal.

In addition to the above configuration, another circuit breaker is known, wherein an alarm-outputting plate that slides in response to a tripping operation of the circuit breaker is combined with the opening and closing mechanism section, so that a mechanical output signal from the alarm-outputting plate can be transmitted to an alarm switch of an internally attached device to open or close the switch, thereby enabling detection of the tripping operation through an electric signal.

In the conventional circuit breakers, the auxiliary switch and the alarm switch as internally attached devices have individually designated installation positions. When the switches are set at these designated positions, the auxiliary switch and the outputting projecting piece of the opening and closing lever, and the alarm switch and the outputting projecting piece of the alarm-outputting plate are respectively linked on a one-to-one correspondence basis.

This makes it impossible to combine these switches flexibly such that the existing auxiliary switch is replaced with an alarm switch, or the alarm switch is replaced with an auxiliary switch, depending on a user's specification.

The present invention has been made in view of this shortcoming, and an object of the invention is to provide an improved circuit breaker having an extended using range, such that the auxiliary and the alarm switches installed in the circuit breaker main body as internally attached devices can be installed in an arbitrary combination, without restriction to their installation positions.

SUMMARY OF THE INVENTION

To attain the above objective, the present invention is directed to a circuit breaker having a mechanism for opening and closing a main circuit contact, including a pivoting opening and closing lever and an alarm-outputting plate that operates in response to a tripping operation. A case of a circuit breaker body has multiple switch housing sections formed on a top surface thereof laterally spaced apart from each other, on which installed are an auxiliary switch for detecting the ON/OFF state of the main circuit contact through an electric signal and/or an alarm switch for detecting the tripping operation through the electric signal. The opening and closing lever and the alarm-outputting plate are arranged opposite to the switch housing sections to correspond to the respective housing sections such that the lever and plate have outputting projecting pieces laterally spaced apart from each other to transmit mechanical output signals to the attached switches set in the housing sections. The outputting projecting pieces of the opening and closing lever are arranged to be offset laterally from the outputting projecting pieces of the alarm-outputting plate.

In the above configuration, the attached switches, namely the auxiliary switch and the alarm switch, each comprises an assembly of a cassette-type unit case installed in a unit housing section, i.e. switch housing section, of the case of the circuit breaker body, a contact mechanism integrated in the unit case, an operating lever for the contact mechanism, and an interlocking arm coupled to the operating lever and drawn out forward from the unit case. The interlocking arm of the auxiliary switch and the interlocking arm of the alarm switch are coupled at different positions, so that when the switches are integrated in the case, the interlocking arm of the auxiliary switch is linked to the outputting projecting piece of the opening and closing lever, while the interlocking arm of the alarm switch is linked to the outputting projecting piece of the alarm-outputting plate.

In the above configuration, the auxiliary and alarm switches in the case of the circuit breaker main body as the attached switches (internally attached devices) can be installed in any arbitrary combination, with no restrictions for the installation positions, thus significantly extending the variation range of the attached switches.

Further, the attached switches used as the auxiliary and alarm switches comprise common parts including the unit case, the contact mechanism, and the operating lever, and are allowed to function as the auxiliary or alarm switches simply by changing the attached position of the interlocking arm coupled to the operating lever, depending on the type of the attached switch, thereby enabling the use of the common parts.

BRIEF DESCRIPTION OF THE DRAWINGS

FIG. 3(*b*) is a perspective view of an opening and closing lever;

FIG. 3(*c*) is a perspective view of an alarm-outputting plate;

FIG. 4(*b*) is a vertical sectional view of FIG. 4(*a*);

FIG. 4(*c*) is a front view of an internal structure in FIG. 4(*a*);

FIG. 5(*b*) is a vertical sectional view of FIG. 5(*a*);

FIG. 5(*c*) is a front view of an internal structure in FIG. 5(*a*);

FIG. 6(*b*) is a view illustrating a condition in which the alarm-outputting plate is linked to the auxiliary and alarm switches.

DETAILED DESCRIPTION OF PREFERRED EMBODIMENTS

Figure 1:
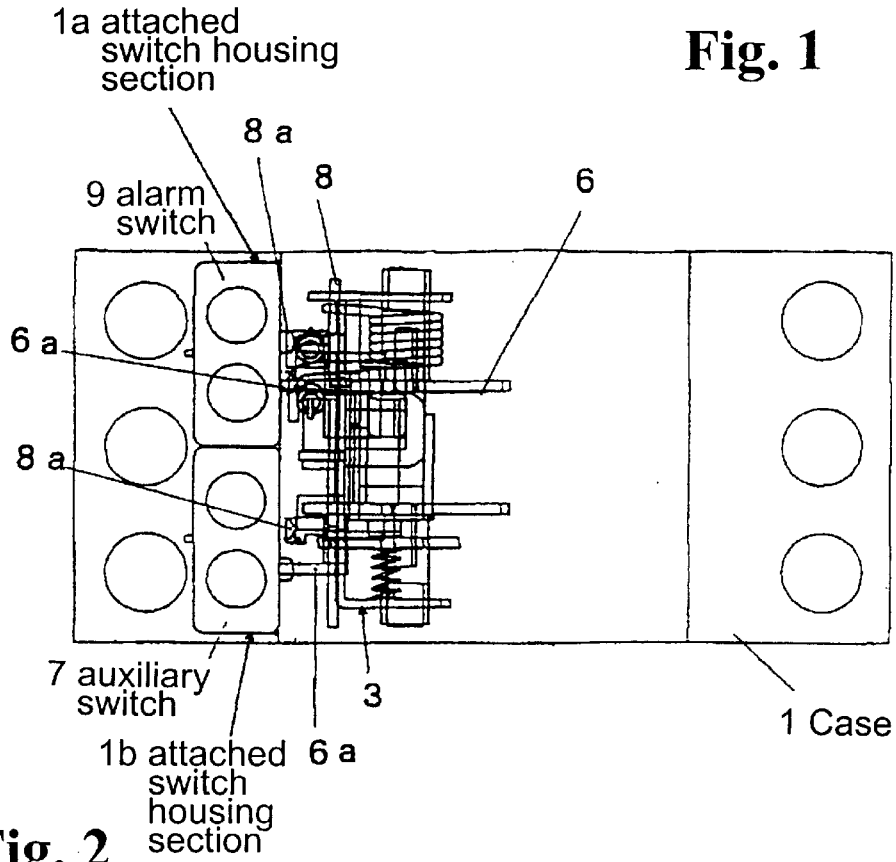
FIG. 1 is a plan view illustrating the structure of a main part of a circuit breaker according to an embodiment of the present invention.

An embodiment of the present invention will be described below with reference to FIGS. 1 to 6(*b*). Members in the figures of the embodiment that correspond to the members in FIG. 7 are denoted by the same reference numerals, and detailed descriptions thereof are omitted.

Figure 2:
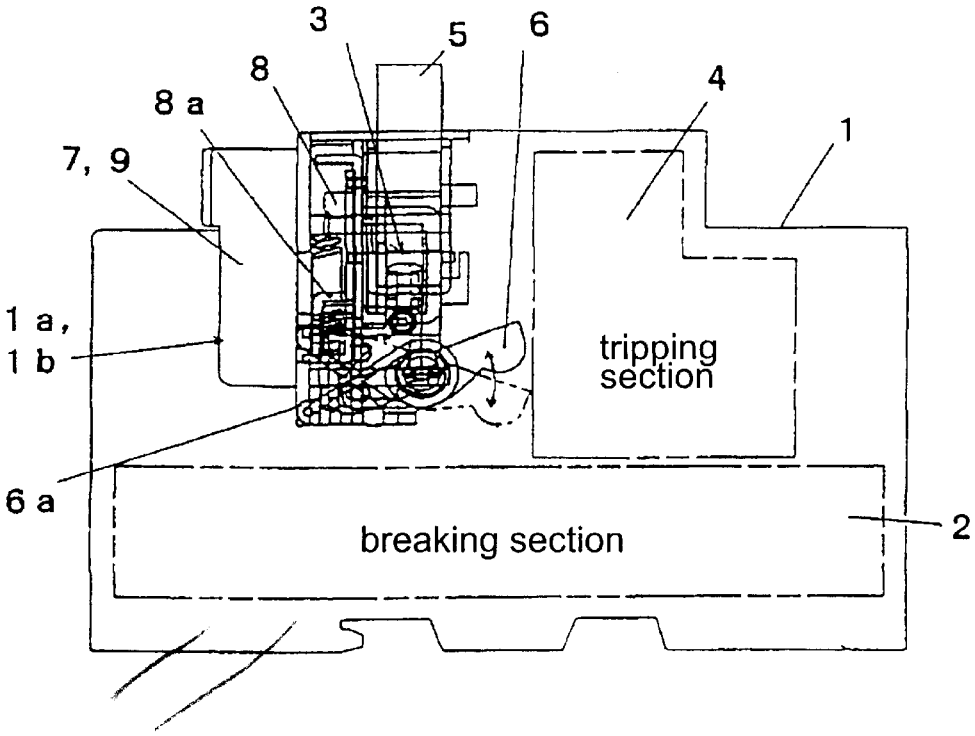
FIG. 2 is a side view of FIG. 1.

In FIGS. 1 and 2, a case 1 has switch housing sections 1*a* and 1*b* formed on a top side thereof arranged laterally side by side, and a cassette-type auxiliary switch 7 and a cassette-type alarm switch 9, the detailed structures of which will be described later, are installed in a plug-in manner.

Further, an opening and closing mechanism section 3 of a circuit breaker main body has a pivoting opening and closing lever 6 assembled therein for opening and closing a main circuit contact of a breaking section 2, as well as an alarm-outputting plate 8 that slides in response to a tripping operation of the circuit breaker. The opening and closing lever 6 and the alarm-outputting plate 8 have outputting projecting pieces 6*a* and 8*a*, respectively, formed at two lateral positions opposite to the switch housing sections 1*a* and 1*b*. The outputting projecting pieces 6*a* of the opening and closing lever 6 are arranged offset laterally from the outputting projecting pieces 8*a* of the alarm-outputting plate 8.

Figure 3A:
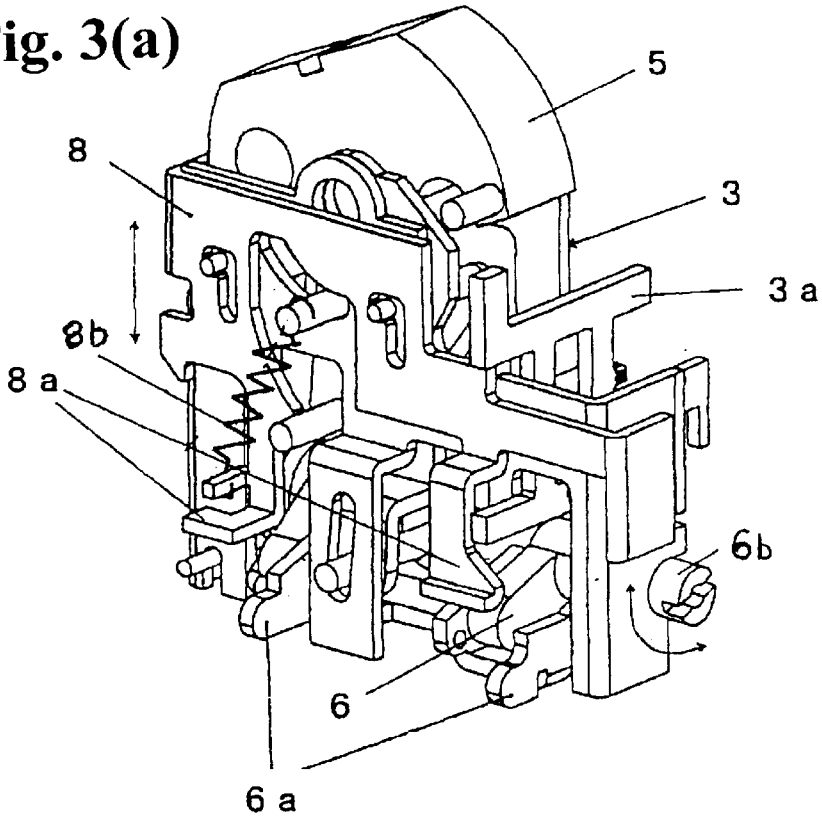
FIG. 3(*a*) is a perspective view depicting an opening and closing mechanism section in FIG. 1, when assembled.
Figure 3B:
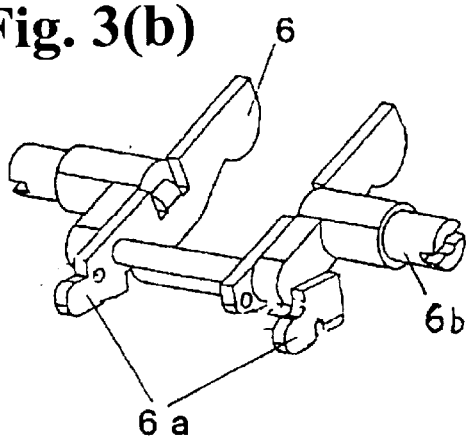
Figure 3C:
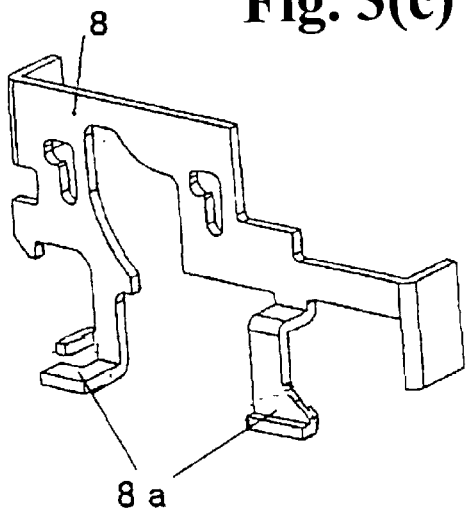

FIGS. 3(*a*) to 3(*c*) depict the assembled structure of the opening and closing mechanism section 3. The opening and closing lever 6 pivots around a support shaft 6*b* due to an operation of the opening and closing mechanism section 3, and the pair of the outputting projecting pieces 6*a* moves in a vertical direction synchronously with this pivotal movement. On the other hand, the alarm-outputting plate 8, installed along a frame of the opening and closing mechanism section 3, is locked and held at an illustrated reset position in a steady state. When a latch receiver 3*a* linked to a tripping section 4 (see FIG. 2) is disengaged from a latch of the opening and closing mechanism section 3 for a tripping operation, the alarm-outputting plate 8 moves slidably upward, impelled by a spring 8*b* in response to this tripping operation, causing the pair of the outputting projecting pieces 8*a* to move upward in response to this sliding movement.

Figure 4A:
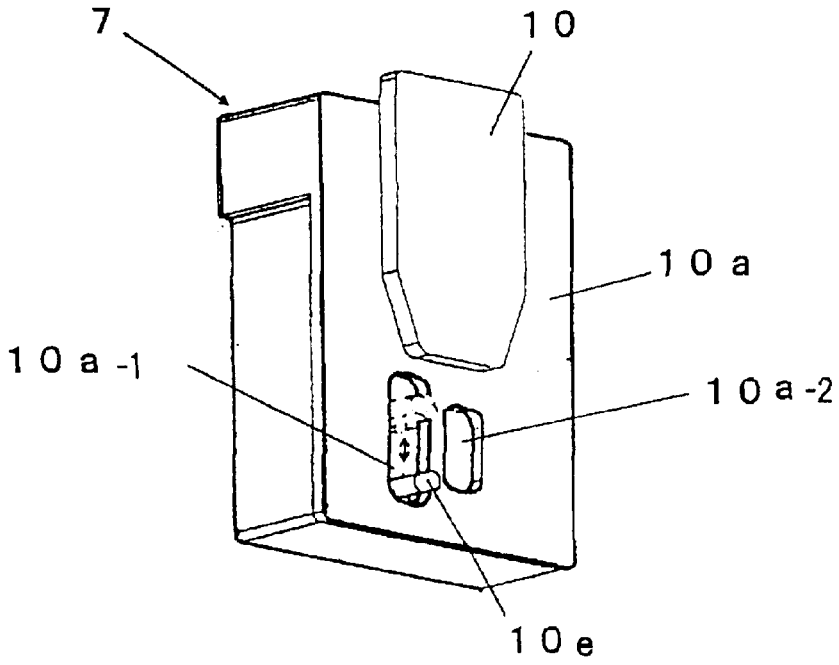
FIG. 4(*a*) is a perspective view depicting an auxiliary switch in FIG. 1.
Figure 4B:
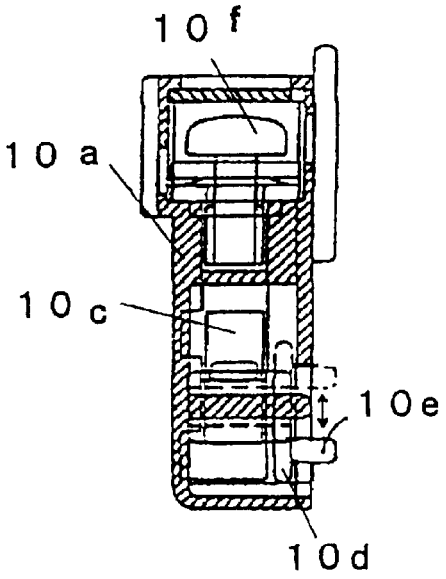
Figure 4C:
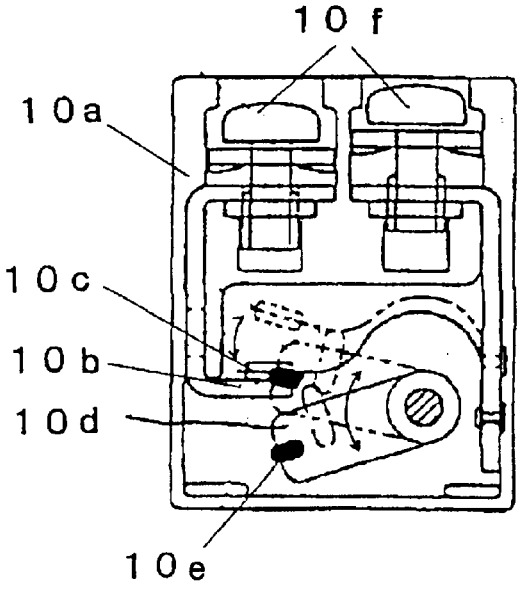

On the other hand, the auxiliary switch 7 and the alarm switch 9 installed in the switch housing sections 1*a* and 1*b* comprise common parts based on a switch or attached switch 10 structured as shown in FIGS. 4(*a*) to 4(*c*) and 5(*a*) to 5(*c*). That is, the attached switch 10 is composed of an assembly of a unit case 10*a*, a contact mechanism composed of a fixed contact shoe 10*b* and a spring-type movable contact shoe 10*c* incorporated in the unit case 10*a*, an operating lever 10*d* linked to the movable contact shoe 10*c*, an interlocking arm 10*e* having one end coupled to the operating lever 10*d* and drawn out forward from the unit case 10*a*, and terminals 10*f*. The unit case 10*a* has window slots 10*a*-1 and 10*a*-2 opening in a front surface thereof at laterally separate positions and respectively opposite to the outputting projecting piece 6*a* of the opening and closing lever 6 and the outputting projecting piece 8*a* of the alarm-outputting plate 8. The interlocking arm 10*e* is drawn out from the window slot 10*a*-1. The contact mechanisms of the auxiliary switch 7 and the alarm switch 9 both use a contacts, which may be changed to b or c contacts.

Figure 5A:
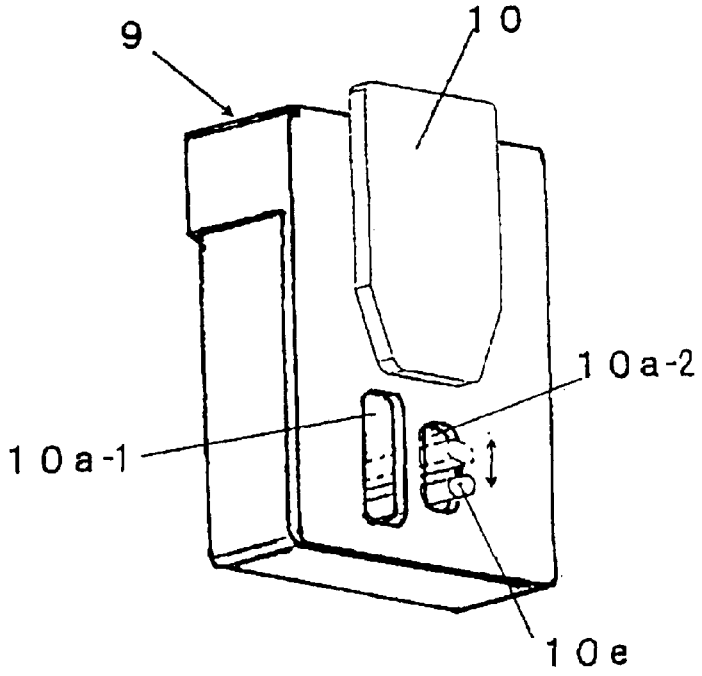
FIG. 5(*a*) is a perspective view depicting an alarm switch in FIG. 1.
Figure 5B:
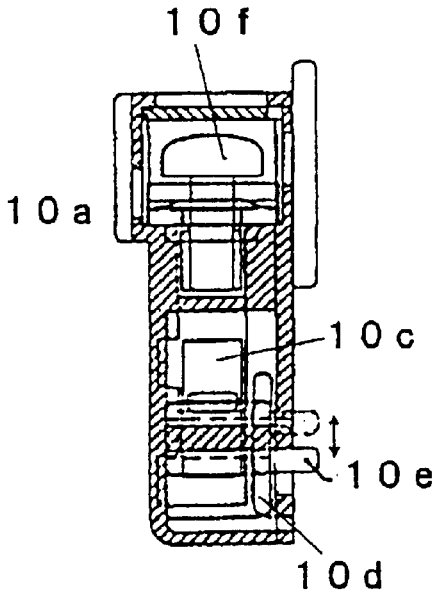
Figure 5C:
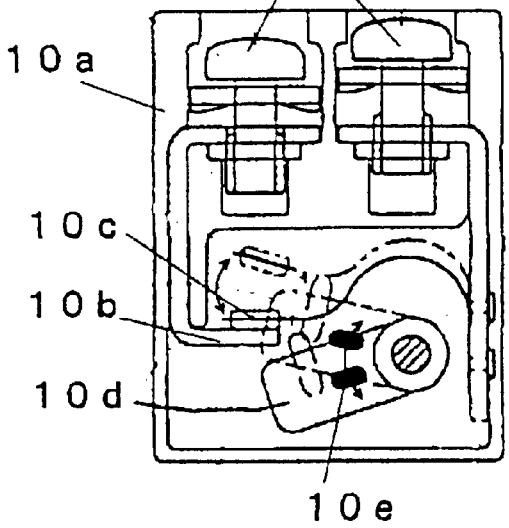

In this case, the auxiliary switch 7 shown in FIGS. 4(*a*)–4(*c*) is assembled so that the interlocking arm 10*e* coupled to the operating lever 10*d* projects from the right-hand window hole 10*a*-1, while the alarm switch 9 shown in FIGS. 5(*a*)–5(*c*) is assembled so that the interlocking arm 10*e* projects from the left-hand window hole 10*a*-2.

Figure 6A:
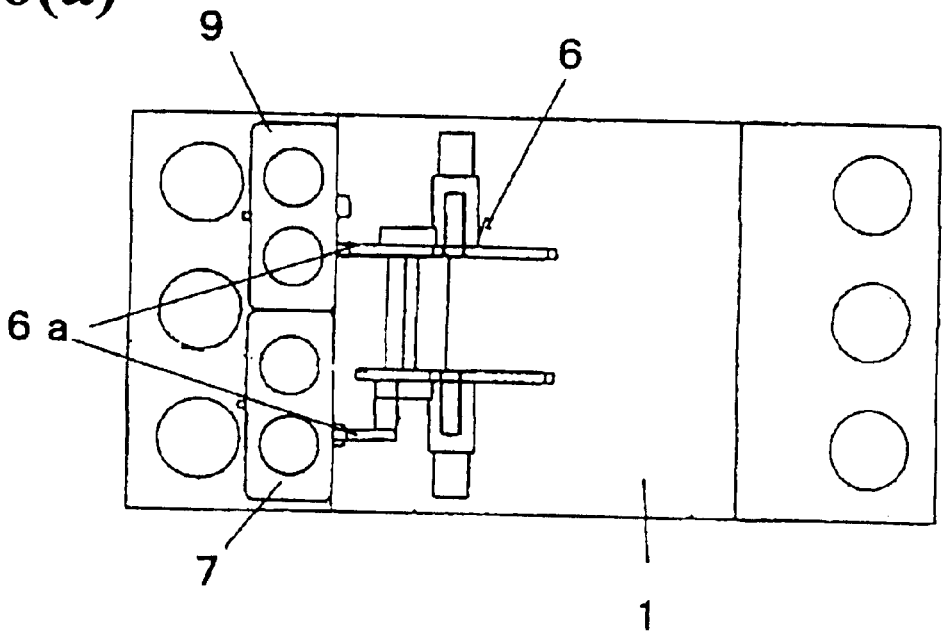
FIG. 6(*a*) is a view illustrating a condition in which the opening and closing lever is linked to the auxiliary and alarm switches.
Figure 6B:
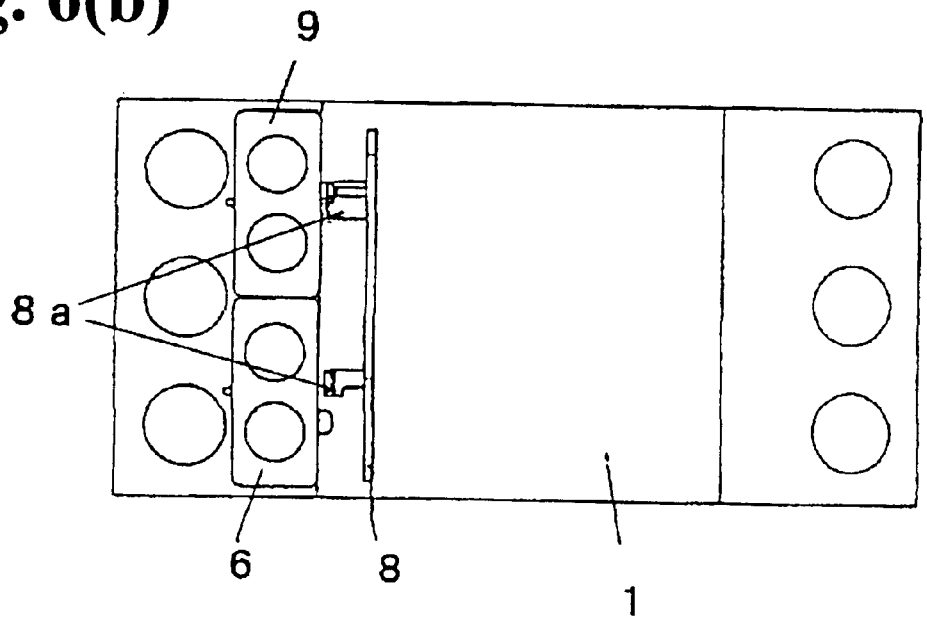
Figure 7:
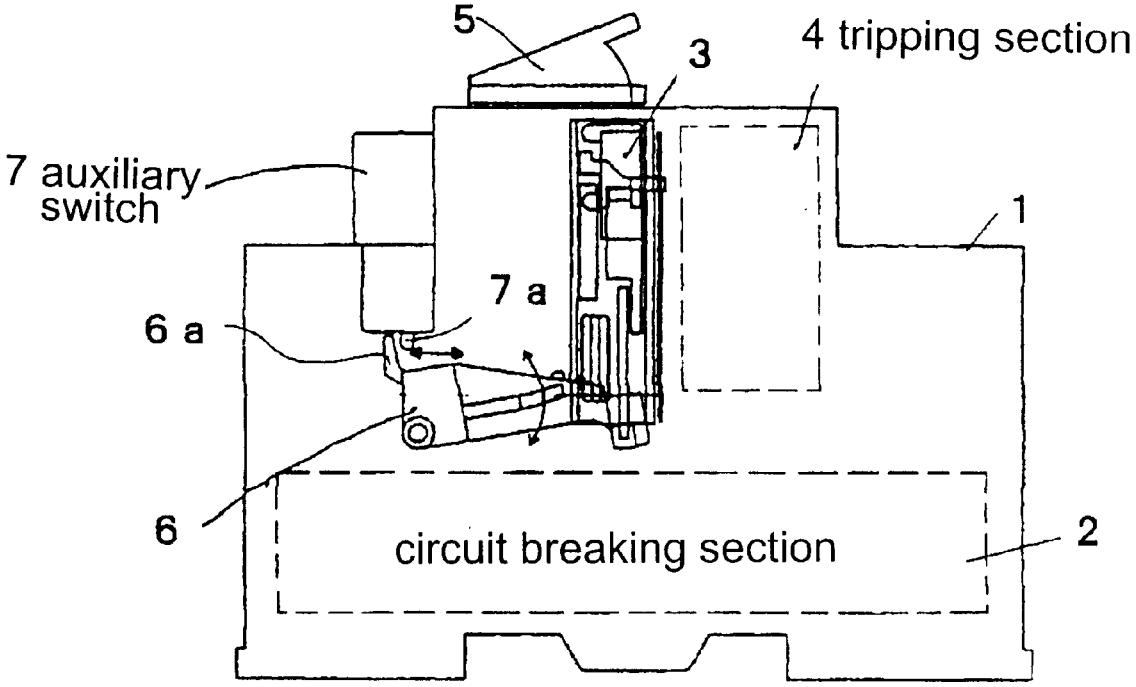
Fig. 7 Prior Art
FIG. 7 is a view schematically illustrating a configuration of an example of a conventional molded-case circuit breaker with an auxiliary switch installed as an internally attached device.

As shown in FIGS. 6(*a*) and 6(*b*), when the auxiliary switch 7 and the alarm switch 9 are installed in the case 1, the interlocking arm projecting from the unit case for the auxiliary switch 7 is located opposite the outputting projecting piece 6*a* of the opening and closing lever 6 (see FIG. 6(*a*)), whereas the interlocking arm projecting from the unit case for the alarm switch 9 is located opposite the outputting projecting piece 8*a* of the alarm-outputting plate 8 (see FIG. 6(*b*)). This locational relationship is used even if the installed positions of the auxiliary switch 7 and the alarm switch 9 are changed in the lateral direction, or if two auxiliary switches 7 or two alarm switches 9 are set in the case 1.

Accordingly, regardless of the installed positions or combination of the auxiliary switches, a mechanical signal from the opening lever 6 is transmitted to the auxiliary switch 7, while the mechanical signal from the alarm-outputting plate 8 is transmitted to the alarm switch 9.

That is, in case the auxiliary switches 7 and/or the alarm switches 9 are installed in the auxiliary switch housing sections formed in the case 1 as the internally attached devices for the circuit breaker, these switches can be arbitrarily combined without any restrictions on their installed positions.

As described above, according to the configuration of the present invention, the auxiliary and alarm switches installed in the main body case as the devices or internally attached devices for the circuit breaker can be installed based on a user's specification, without restrictions to the installation positions or combination of the switches, thereby making it possible to significantly extend the variation range of the attached switches.

Further, the attached switches used as the auxiliary and alarm switches include common parts including the unit case, the contact mechanism, and the operating lever, and are allowed to function as the auxiliary or alarm switch simply by changing the attached position of the interlocking arm coupled to the operating lever, depending on the type of the attached switch, thereby enabling the use of the common parts. This provides a circuit breaker flexible in terms of the internally attached devices.

While the invention has been explained with reference to the specific embodiment of the invention, the explanation is illustrative and the invention is limited only by the appended claims.

What is claimed is:

1. A circuit breaker comprising:

a case having a plurality of switch housing sections arranged laterally, a circuit breaker body situated in the case and having a main circuit contact, an opening and closing mechanism for opening and closing the main circuit contact disposed in the case and including a pivoting opening and closing lever, a tripping device disposed in the case, a plurality of switches to be attached to the switch housing sections, and an alarm-outputting plate operating in response to a tripping operation of the tripping device, wherein said opening and closing lever and said alarm-outputting plate are disposed opposite the switch housing sections so as to correspond to each of the housing sections, and include outputting projecting pieces laterally spaced apart from each other, respectively, for transmitting mechanical output signals to the switches set in the housing sections, said outputting projecting pieces of the opening and closing lever being offset laterally from the outputting projecting pieces of the alarm-outputting plate.

2. A circuit breaker according to claim 1, wherein said plurality of switches includes an auxiliary switch for detecting an ON/OFF state of the main circuit contact through an electric signal, and an alarm switch for detecting the tripping operation through an electric signal.

3. A circuit breaker according to claim 2, wherein each of said switches as the auxiliary switch and the alarm switch has a unit case as a cassette installed in the switch housing section of the case, a contact mechanism installed in the unit case, an operating lever for the contact mechanism, and an interlocking arm coupled to the operating lever and drawn out from the unit case.

4. A circuit breaker according to claim 3, wherein the interlocking arm of the auxiliary switch and the interlocking arm of the alarm switch are coupled to the operating levers at different positions such that in a position where the auxiliary and alarm switches are integrated in the case, the interlocking arm of the auxiliary switch is linked to the outputting projecting piece of the opening and closing lever, while the interlocking arm of the alarm switch is linked to the outputting projecting piece of the alarm-outputting plate.

5. A circuit breaker according to claim 1, wherein one of the outputting projecting pieces of the opening and closing lever and the alarm-outputting plate is selected as desired in one switch housing section.

* * * * *